United States Patent [19]

Nitta et al.

[11] Patent Number: 4,662,826

[45] Date of Patent: May 5, 1987

[54] VACUUM PUMP SYSTEM INCLUDING SERIALLY CONNECTED ROTARY AND RECIPROCATING VACUUM PUMPS

[75] Inventors: Michio Nitta, Tokyo; Hiroyuki Suzuki; Yoshifumi Fukuhara, both of Kanagawa, all of Japan

[73] Assignee: Tokico Ltd., Kanagawa, Japan

[21] Appl. No.: 724,284

[22] Filed: Apr. 17, 1985

[30] Foreign Application Priority Data

| | | | |
|---|---|---|---|
| Apr. 20, 1984 | [JP] | Japan | 59-79956 |
| Feb. 20, 1985 | [JP] | Japan | 60-32450 |
| Feb. 20, 1985 | [JP] | Japan | 60-22941[U] |
| Feb. 20, 1985 | [JP] | Japan | 60-22949[U] |

[51] Int. Cl.[4] ..... F04B 23/10

[52] U.S. Cl. ..... 417/206; 417/244

[58] Field of Search ..... 417/199 R, 205, 206, 417/244, 426; 418/3

[56] References Cited

U.S. PATENT DOCUMENTS

| | | | |
|---|---|---|---|
| 1,770,297 | 7/1930 | Bussmann | 417/206 |
| 1,936,935 | 11/1933 | Fitch et al. | 417/206 |
| 2,407,923 | 9/1946 | Gall | 417/206 |
| 4,504,201 | 3/1985 | Wycliffe | 418/3 |
| 4,529,363 | 7/1985 | Suzuki | 418/201 X |

FOREIGN PATENT DOCUMENTS

| | | | |
|---|---|---|---|
| 955352 | 1/1957 | Fed. Rep. of Germany | 417/205 |
| 1145502 | 3/1963 | Fed. Rep. of Germany | 417/199 R |
| 67810 | 6/1977 | Japan | 417/205 |
| 540580 | 10/1941 | United Kingdom | 417/205 |
| 597437 | 1/1948 | United Kingdom | 417/205 |
| 2094402 | 9/1982 | United Kingdom | 417/199 R |

*Primary Examiner*—Carlton R. Croyle
*Assistant Examiner*—Paul F. Neils
*Attorney, Agent, or Firm*—Wenderoth, Lind & Ponack

[57] ABSTRACT

A vacuum pump includes a rotary vacuum pump including a pair of rotors cooperating to suck gas, a driving source connected to a shaft of one of the pair of rotors, timing gears connected to respective shafts of the rotors and transmitting the driving force of the driving source between the shafts of the pair rotors, and a reciprocating vacuum pump connected to the driving source and connected to the downstream side of the rotary vacuum pump for sucking gas therefrom.

3 Claims, 7 Drawing Figures

VACUUM PUMP SYSTEM INCLUDING SERIALLY CONNECTED ROTARY AND RECIPROCATING VACUUM PUMPS

BACKGROUND OF THE INVENTION

This invention relates to a vacuum pump.

It is known to combine a plurality of rotary vacuum pumps or to combine a plurality of reciprocating vacuum pumps for attaining a high degree of vacuum. However, there are shortcomings that, in the former, it is required to connect in series a multiple number of rotary vacuum pumps for obtaining desired high vacuum because of airtightness or leakage which complicates the construction and, in the latter, there is a problem of a mist of lubricating oil for the reciprocating type vacuum pump entering the stage of high vacuum.

SUMMARY OF THE INVENTION

An object of the invention is to overcome the aforesaid shortcomings and, according to the invention, there is provided a vacuum pump comprising a rotary vacuum pump including a pair of rotors cooperating to suck gas, a driving source connected to a shaft of one of said rotors, a timing gear device for transmitting the driving force of the driving source to a shaft of the other of said rotors, and a reciprocating vacuum pump connected to either one of said shafts and connected to the rotary pump for sucking gas therefrom.

The outlet of the rotary vacuum pump is connected to the inlet of the receiprocating vacuum pump, thus, desired high vacuum can be obtained efficiently and the construction is of the pump simplifed and the size thereof is compact.

The rotary vacuum pump and/or the reciprocating vacuum pump may consist of a plurality of vacuum pumps of the same type.

Preferably, a timing gear chamber is sealingly formed between the rotary vacuum pump and the reciprocating vacuum pump for receiving therein the timing gear device, and the shafts of respective rotors of the rotary vacuum pump extend through the timing gear chamber, with one the the shafts being connected to the reciprocating vacuum pump and the other of the shafts being connected to the driving source.

According to an embodiment of the invention, the rotary vacuum pump is connected to the driving source through a releasable clutch, a pressure sensor is provided in a passage connecting the outlet of the rotary vacuum pump to the inlet of the reciprocating vacuum pump, and a control device is connected to the pressure sensor for controlling the engagement of the release of the clutch. According to another embodiment of the invention, a by-pass passage is provided for by-passing at least a part of the rotary vacuum pump, a pressure sensor is provided to detect the pressure in the inlet of the rotary vacuum pump, valve mechanisms are provided respectively in the by-pass passage and in the inlet of the rotary vacuum pump, and a control device is connected to the pressure sensor for controlling the valve mechanisms.

BRIEF EXPLANATION OF THE DRAWINGS:

Further objects and advantages of the invention will become apparent from the following detailed description taken in connection with the accompanying drawings, in which.

DETAILED DESCRIPTION OF THE PREFERRED EMBODIMENT

Figure 1:
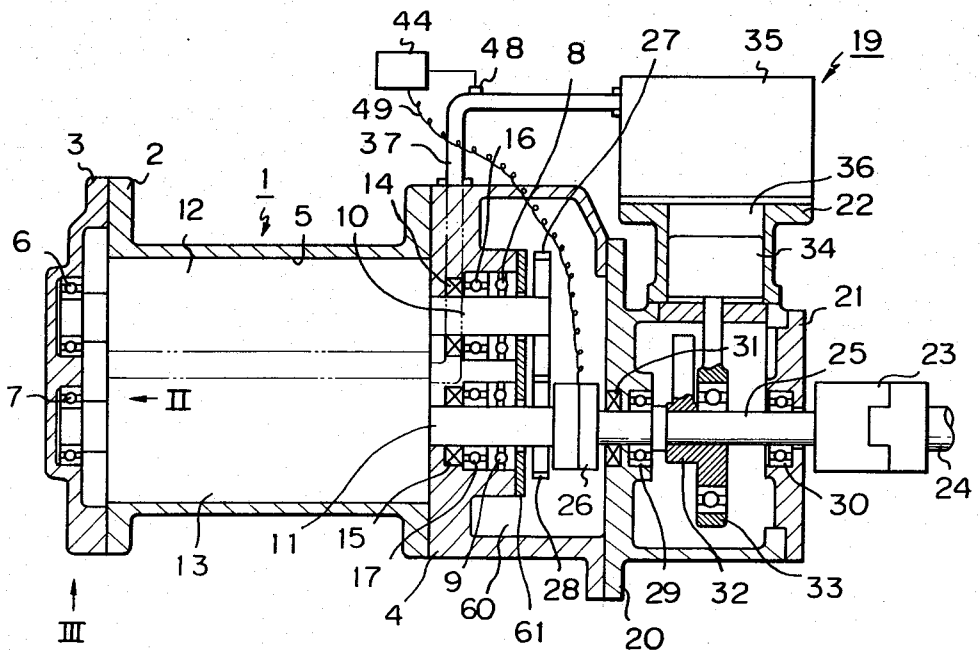
FIG. 1 is a longitudinal sectional view of a vacuum pump according to a first embodiment of the invention.
Figure 2:
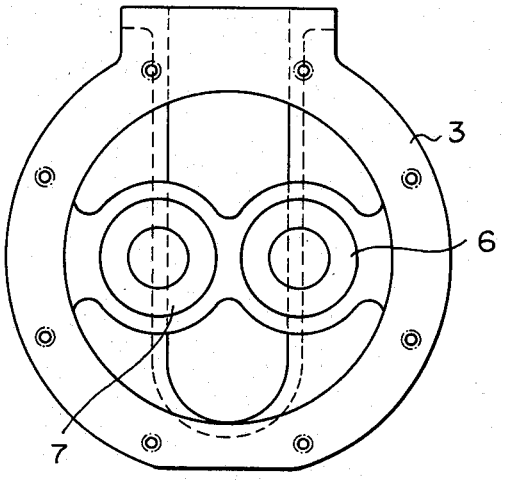
FIG. 2 is a plan view of a cover as viewed in the direction of arrow II in FIG. 1.
Figure 3:
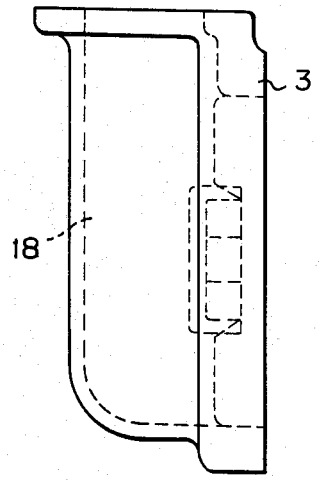
FIG. 3 is a side view of the cover of FIG. 2 as viewed in the direction of arrow III in FIG. 1.

FIG. 1 shows a vacuum pump according to the invention which comprises a rotary vacuum pump 1 and a reciprocating vacuum pump 19. The rotary vacuum pump 1 comprises a tubular casing 2, and an inlet cover 3 and an outlet side cover 4 secured respectively to opposite ends of the casing 2 to define a vacuum chamber 5 therein. A female rotor 12 and a male rotor 13 meshingly engaging with one another are rotatably disposed in the vacuum chamber 5 with shafts 10 and 11 thereof supported by bearings 6, 8, 16 and 7, 9, 17 respectively. Shown at 14 and 15 are oil seals. FIGS. 2 and 3 show the details of the cover 3 which is of conventional type. It will be understood that the cover 3 shown in FIG. 1 is schematically shown, and an inlet chamber 18 is omitted from FIG. 1. The inlet chamber 18 formed in the cover 3 is connected to an object (not shown) the internal pressure of which is to be reduced to a desired high vacuum by the vacuum pump according to the invention.

The cover 4 of the outlet side is connected to a casing 20 of reciprocating vacuum pump 19. A cover 21 is secured to the casing 20 on the side remote from the cover 4, and a cylinder 22 is mounted on the casing 20. A crank shaft 25 is connected to a driving source (not shown) through a driving shaft 24 and a coupling 23 extends through the interior of the casing 20, and is connected to the shaft 11 of the rotor 13 through an electromagnetic clutch 26 which is disposed in the cover 4. The shaft 11 of the rotor 13 is connected to the shaft 10 of the rotor 12 through timing gears 27 and 28. The crank shaft 25 is supported by bearings 29 and 30. Shown at 31 is a seal ring. A piston 34 is slidably disposed in the cylinder 22 and is connected to the crank shaft 25 through a connecting rod 33. Shown at 32 is a balance weight. The outer end of the cylinder 22 is covered by a cylinder head 35 to define a vacuum chamber 36 in the cylinder 22. A spring biased inlet valve and a spring biased outlet valve (not shown) are disposed inthe cylinder according to conventional practice.

The outlet side of the rotary vacuum pump 1 and the inlet side of the reciprocating vacuum pump 19 are connected through a passage 37. Thus, the object connected to the inlet side of the rotary vacuum pump 1 is evacuated by two vacuum pumps 1 and 19 which are connected in series.

A pressure sensor 48 is mounted in the passage 37 for detecting the pressure in the passage 37. The sensor 48 is connected to a control device 44 which is connected to the electromagnetic clutch 26 through line 49.

The operation of the vacuum pump shown in FIG. 1 will now be explained. The driving force of the driving source is transmitted to the crank shaft 25 through the driving shaft 24 and the coupling 23. The piston 34 reciprocatingly moves in the cylinder 22 thereby reducing the pressure in the vacuum chamber 36 and in the passage 37. Since the clutch 26 is normally at connected condition, the shafts 11 and 10 of rotors 13 and 12 are also rotatingly driven, so that the inlet chamber 18 of the rotary vacuum pump 1 is evacuated by two vacuum pumps 1 and 19.

When the pressure in the passage 37 elevates over a predetermined pressure owing to such as leakage and the like, the sensor 48 supplies a signal to the control device 44, and the control device 44 actuates the clutch 26 to a released condition thereby disconnecting the shaft 11 of the rotary vacuum pump 1 from the driving source. The driving force can be reduced substantially.

When the pressure in the passage 37 decreases to a predetermined pressure, the control device 44 again connects the clutch 26 thereby actuating the vacuum pump 1 again. Preferably, the clutch 26 is at the released condition when the pressure in the passage 37 is equal to or near to atmospheric pressure so that only the reciprocating vacuum pump 19 is actuated in starting the vacuum pump according to the invention from atmospheric pressure condition making it possible to reduce the driving force in the initial condition and increasing efficiency. The electromagnetic clutch may be replaced by a mechanical clutch having a pressure responsive member biased by a spring.

Figure 4:
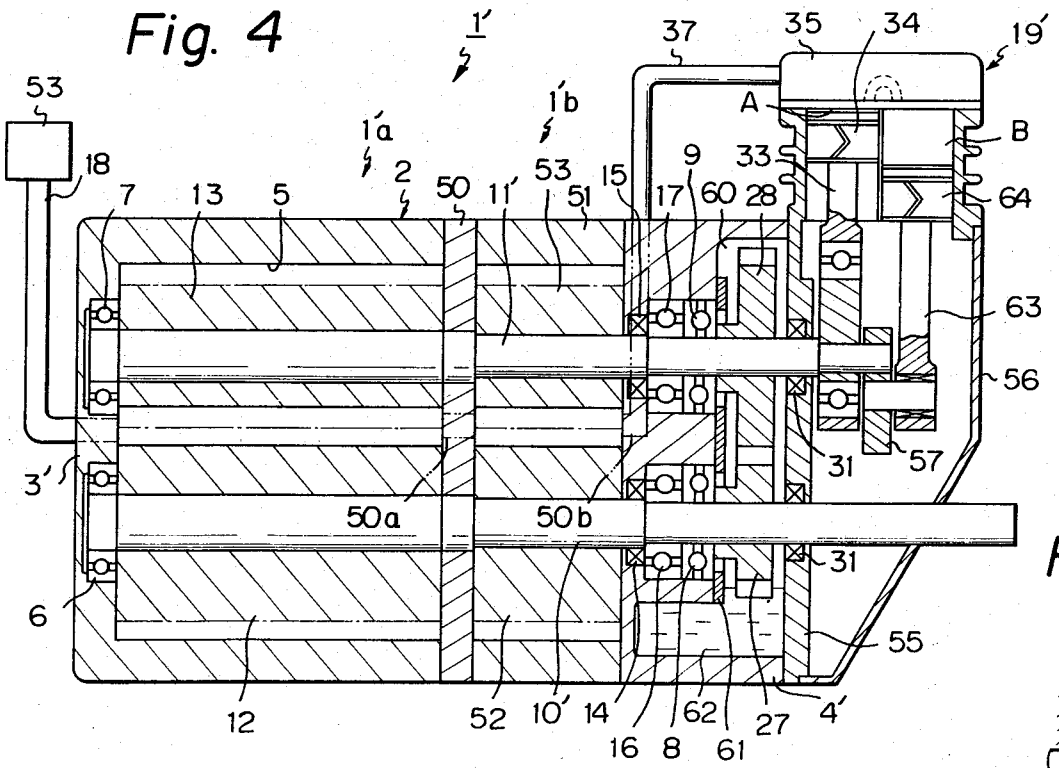
FIG. 4 is a longitudinal sectional view of a vacuum pump according to a second embodiment of the invention.

The second embodiment shown in FIG. 4 is generally similar to the first embodiment, and the same reference numerals are applied to parts corresponding to the first embodiment.

The rotary vacuum pump 1 in the first embodiment is replaced by a rotary vacuum pump 1' consisting of two axially aligned and axially adjacently disposed rotary vacuum pumps 1'*a* and 1'*b* which are connected in series and having common shafts 10' and 11'. The pumps 1'*a* and 1'*b* are partitioned by a partition wall 50, and an opening 50*a* is formed through the partition wall 50 to act as an outlet of the rotary vacuum pump 1'*a* and an inlet of the rotary vacuum pump 1'*b*. An outlet 50*b* of the rotary vacuum pump 1'*b* is communicated through the passage 37 to the cylinder head 35 of reciprocating vacuum pump 19'. The rotary vacuum pump 1'*b* comprises rotors 52 and 53 which are generally similar to rotors 12 and 13 of the rotary vacuum pump 1'*a* and are mounted on shafts 10' and 11' respectively.

A cover 4' closes outlet side of the rotary vacuum pump 1'*b* and a cylinder casing 55 closes one end of the cover 4' remote from the rotary vacuum pump 1' to form a sealed timing gear chamber 60 within the cover 4' to receive therein timing gears 27 and 28. The lower portion of the chamber 60 acts as a reservior 62 of lubricating oil.

Two cylinder bores are formed in the cylinder casing 55 to receive reciprocatingly pistons 34 and 64 respectively to constitute reciprocating vacuum pumps A and B respectively. In this embodiment, the reciprocating vacuum pumps A and B are connected in series, but it is possible to connect both pumps A and B in parallel. Pistons 34 and 64 are driven by a crank shaft 57 through connecting rods 33 and 63 respectively, and the crank shaft 57 is connected to the shaft 11' of the rotary vacuum pump 1'. The shaft 10' of the rotary vacuum pump 1' extends through the cover 4' and the cylinder casing 55 and is connected to the driving source (not shown). In this embodiment, the crank shaft 57 is constituted as an eccentric mechanism. Shown at 53 is the object to be evacuated by the vacuum pump according to the invention.

Preferably, the pressure in the timing gear chamber 60 is maintained at a pressure nearly equal to the pressure in the passage 37, thus, leakage of oil from the timing gear chamber 60 to the rotary vacuum pump 1' can be minimized thereby eliminating the problem of oil mist and the like entering into the rotary vacuum pump.

The operation of the embodiment of FIG. 4 is generally similar to that of the first embodiment.

According to the invention, the rotary vacuum pump 1' and the reciprocating vacuum pump 19' are connected in series with the reciprocating vacuum pump on the downstream side, thus, it is possible to obtain desired high vacuum efficiently with the problem of oil mist and the like being eliminated. Further, the vacuum pump is simple in construction and compact in size.

Figure 5:
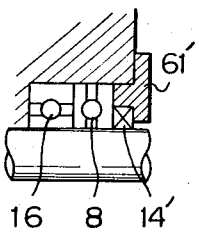
FIG. 5 is a partial view showing a modified arrangement of radial and thrust bearings of the embodiment of FIG. 4.

FIG. 5 shows a modified arrangement of ball and thrust bearings 8 and 16, the seal ring 14 and a retaining plate 61 in the embodiment of FIG. 4. However, it is required to lubricate the thrust and radial ball bearings 8, 16 and the like with lubricant, and the seals 14 and 15 are preferably disposed adjacent to the rotary vacuum pump as shown in FIGS. 1 and 4.

Shafts 10' and 11' extend through the cylinder casing 55 through seals 31 respectively, and through the cover 4 through seals 14 and 15 respectively, thus, the interior of the cover 4 or the timing gear chamber 60 can be maintained at a pressure nearly equal to the pressure in the passage 37. Therefore, lubricant oil 62 in the timing gear chamber is reliably prevented from leaking into the rotary vacuum pump 1', whereby it is possible to improve the quality of the vacuum in the object 53.

According to this embodiment, a driving source (not shown) is connected to the shaft 10' and the reciprocating vacuum pump 19' is connected to the other shaft 11', thus, it is possible to minimize the size of the vacuum pump consisting of integrally mounted rotary vacuum pump and reciprocating vacuum pumps.

The operation of the vacuum pump 1' shown in FIG. 4 is similar to the vacuum pump 1 in FIG. 1, thus, detailed explanation therefor is omitted.

Figure 6:
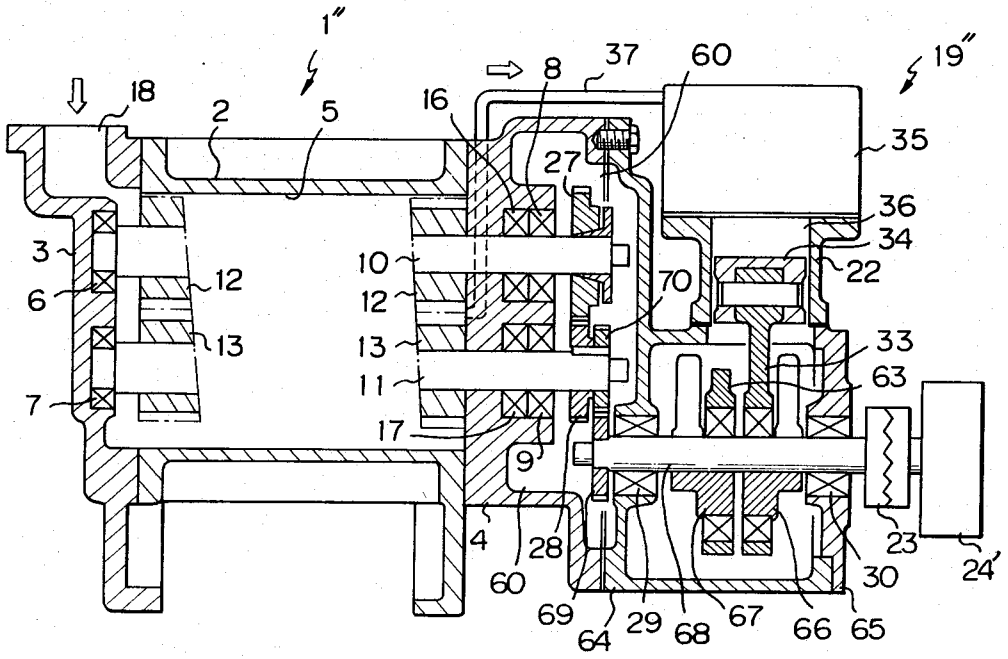
FIG. 6 is a longitudinal sectional view of a vacuum pump according to a third embodiment of the invention.

FIG. 6 shows the third embodiment of the invention, wherein parts similar to the embodiments of FIGS. 1 and 4 are denoted by the same reference numerals and detailed description therefor is omitted.

In FIG. 6, a reciprocating vacuum pump 19'' includes the two cylinder and piston assemblies, with one of the cylinder and piston assemblies not being shown entirely and only a connecting rod 63 and an eccentric cam 67 connecting a driving shaft 68 with the connecting rod 63 being shown with respect to such one cylinder and piston assembly. Further, in the drawing, the bearings 6, 7 and the like are shown schematically and seals are omitted, but, they are provided according to conventional practice.

The driving shaft 68 connected to a driving source 24' through the coupling 23 drives a rotary vacuum pump 1'' through gears 69 and 70, thus, it is possible to drive the rotary vacuum pump 1'' at a speed different from the reciprocating vacuum pump 19'', whereby both of the reciprocating vacuum pump 19″ and the rotary vacuum pump 1″ can be driven at optimum speeds, and the efficiency can be increased to the maximum.

The reciprocating vacuum pump 19″ according to the embodiment can be assembled as a sub-assembly independent from rotary vacuum pump 1″ which also constitutes a subassembly, thus, the assembling operation can be performed easily.

The operation of the embodiment shown in FIG. 6 is similar to embodiments of FIGS. 1 and 4.

Figure 7:
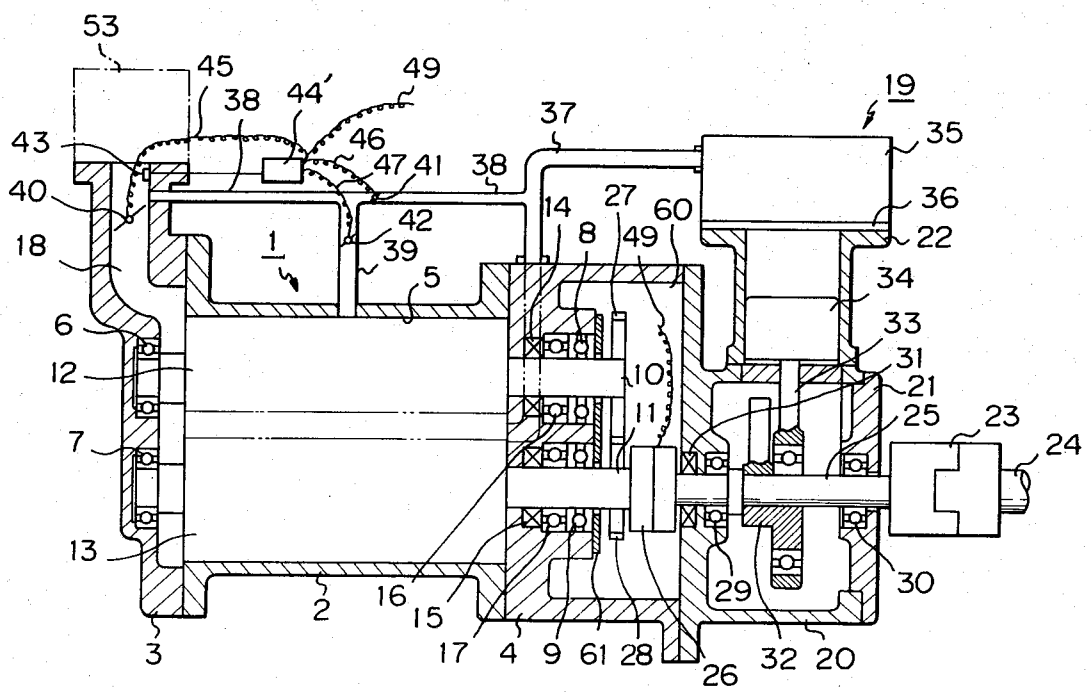
FIG. 7 is a longitudinal sectional view of a vacuum pump according to a fourth embodiment of the invention.

FIG. 7 shows a fourth embodiment of the invention which is generally similar to the embodiment of FIG. 1, and the same reference numerals are applied to corresponding parts.

The passage 37 connecting the outlet side of the rotary vacuum pump 1 with the inlet side of the reciprocating vacuum pump 19 is connected to a by-pass passage 38 which connects the inlet 18 of the rotary vacuum pump 1 with the passage 37. A second by-pass passage 39 connects an intermediate portion of the rotary vacuum pump 1 with the by-pass passage 38. There are provided valves 40, 41 and 42 in the inlet 18, the by-pass passage 38 and the by-pass passage 39 respectively and are controlled by a control device 44′ through lines 45, 46 and 47 respectively. A pressure sensor 43 is provided in the inlet 18 and is connected to the control device 44′. The clutch 26 is also connected to the control device 44′ through line 49.

In operation, the object 53 is evacuated by the reciprocating vacuum pump 19 only at the initial stage until the pressure in the inlet 18 decreases to a predetermined low pressure. For such operation, the valve 41 is opened, the valves 40 and 42 are closed, and the clutch 26 is released. The rotary vacuum pump 1 is not operated. When the pressure in the inlet 18 decreases to the predetermined pressure, the valve 41 is closed and the valve 42 is opened and the clutch 26 connects the rotary vacuum pump 1 with the driving source. The rotary vacuum pump 1 operates at a reduced rate. Thereafter, when the pressure in the inlet 18 is further decreased to another predetermined pressure, the valve 40 is opened and the valve 42 is opened. The rotary vacuum pump 1 operates at a full load.

Therefore, according to this embodiment, the load or the driving force of the driving source can be minimized particularly in starting the vacuum pump.

The vacuum pump according to the invention, particularly the rotary pump thereof, is preferably of an oil free type or an oil less type whereby it is possible to reliably prevent the reverse flow of oil or oil mist into the inlet chamber 18 of the rotary vacuum pump and to remove oil or oil mist from the interior of the object being evacuated. Such arrangment is particularly adapted to an apparatus for producing semi-conductors and the like.

The by-pass passage 39 may be omitted, or alternatively, it is possible to provide two or more by-pass passages 39.

As described heretofore, according to the invention, one or more rotary vacuum pumps and one or more reciprocating vacuum pumps are mounted integrally and driven by a common driving force, and the outlet of the rotary vacuum pump is connected in series with the inlet of the reciprocating vacuum pump. Thus, the evacuating operation can be performed efficiently, and the pump is simple in the construction, compact in the size, and easy to manufacture and assemble. Further, oil mist and the like can be prevented from entering into the object being evacuated.

Further according to the preferred embodiments, the operation of the rotary vacuum pump and the reciprocating vacuum pump can efficiently be controlled.

What is claimed is:

1. A vacuum pump assembly comprising:

a rotary vacuum pump including a cylindrical housing, a pair of rotors having shafts which are parallel to each other and to the axis of said housing, and inlet side and outlet side covers provided at and closing opposite axial ends of said housing, said rotor shafts being rotatably supported by said covers, said inlet and outlet side covers respectively having inlet and outlet ports of said rotary vacuum pump, said pair of rotors cooperating to axially drive air towards said outlet port from said inlet port;

a reciprocating piston vacuum pump including a housing positioned at a side of said outlet side cover opposite to a side thereof at which said housing of said rotary vacuum pump is provided, and a crank shaft extending parallel to said shafts of said rotors, a first end of said crank shaft extending away from said outlet side cover and being adapted to be connected to a drive motor;

a gear casing between said outlet side cover and said housing of said reciprocating piston vacuum pump, ends of said rotor shafts and a second end of said crank shaft projecting into said gear casing, said gear casing including gear means for transmitting the driving force of the drive motor from said second end of said crank shaft to said end of one of said rotor shafts to thereby drive the rotary vacuum pump at a speed different from the reciprocating piston vacuum pump, and timing gear means for transmitting said driving force from said end of said one rotor shaft to said end of said other rotor shaft; and connecting means connecting said outlet port of the rotaryu vacuum pump to the inlet of said reciprocating piston vacuum pump.

2. A vacuum pump assembly as claimed in claim 1, wherein said reciprocating piston vacuum pump includes a plurality of cylinder and piston assemblies which are adapted to be driven by said crank shaft.

3. A vacuum pump assembly as claimed in claim 1, wherein said reciprocating piston vacuum pump is assembled as a sub-assembly independent from said rotary vacuum pump, and said reciprocating piston vacuum pump is releasably mounted on said outlet side cover of said rotary vacuum pump.

* * * * *